US007052358B2

(12) United States Patent
Alessi

(10) Patent No.: US 7,052,358 B2
(45) Date of Patent: May 30, 2006

(54) UNDERGARMENT FOR LACTATING WOMEN

(76) Inventor: Christine V. Alessi, Chemin de la Chenaie, 18, Bellevue (CH) 1293

( * ) Notice: Subject to any disclaimer, the term of this patent is extended or adjusted under 35 U.S.C. 154(b) by 0 days.

(21) Appl. No.: 10/928,432

(22) Filed: Aug. 27, 2004

(65) Prior Publication Data

US 2006/0046616 A1 Mar. 2, 2006

(51) Int. Cl.
*A41C 3/00* (2006.01)

(52) U.S. Cl. ..... 450/37; 450/54

(58) Field of Classification Search ..... 450/36, 450/37, 38, 54–57, 39, 60–66, 74, 75, 89, 450/93; 2/463, 92, 271, 272
See application file for complete search history.

(56) References Cited

U.S. PATENT DOCUMENTS

| | | | | |
|---|---|---|---|---|
| 1,989,382 A | | 1/1935 | Schnaittacher | |
| 2,440,466 A | * | 4/1948 | Freedman | 450/55 |
| 2,594,549 A | * | 4/1952 | Flores et al. | 450/54 |
| 2,621,328 A | * | 12/1952 | Duchnofskey | 450/53 |
| 2,641,763 A | * | 6/1953 | Schroeder | 450/54 |
| 4,854,915 A | * | 8/1989 | Luedy | 450/31 |
| 5,116,278 A | * | 5/1992 | Sroub et al. | 450/61 |
| 5,149,336 A | * | 9/1992 | Clarke et al. | 604/388 |
| 5,441,436 A | | 8/1995 | Moretz et al. | |
| 5,553,468 A | | 9/1996 | Osborne | |
| 5,592,836 A | | 1/1997 | Schuster et al. | |
| 5,605,060 A | | 2/1997 | Osborne | |
| 5,850,745 A | | 12/1998 | Albright | |
| 5,944,579 A | | 8/1999 | Fleischman | |
| 5,946,944 A | * | 9/1999 | Osborne | 66/176 |
| 6,287,168 B1 | | 9/2001 | Rabinowicz | |
| 6,443,805 B1 | * | 9/2002 | Kirkwood | 450/31 |

* cited by examiner

*Primary Examiner*—Gloria M. Hale
(74) *Attorney, Agent, or Firm*—Lawrence E. Laubscher, Jr.

(57) ABSTRACT

An undergarment for lactating women includes a front panel extending over a woman's breasts and shoulders and a pair of absorbent pads placed within the front panel and covering the nipples to absorb extraneous discharge. The panels are made of a stretchable, breathable knit fabric. The undergarment includes a back panel attached to the front panel and forming openings for the arms, neck and torso. The absorbent pads, preferably removable, are placed within the front panel of the garment.

2 Claims, 1 Drawing Sheet

UNDERGARMENT FOR LACTATING WOMEN

BACKGROUND OF THE INVENTION

The present invention relates to an undergarment for lactating and breastfeeding women. Mothers with newly born infants, while still in the maternity ward or while nursing, need a lightweight, stretchable, comfortable, breathable, disposable undergarment, which holds absorbent material to collect extraneous discharge when not feeding the child from the breast nipple area. The undergarment is made from a stretchable, breathable knot material, and is available in one-size fits most. The undergarment holds absorbent pads covering the nipple area. The disposable absorbent pads allow for easy replacement during the life of the undergarment.

BRIEF DESCRIPTION OF THE PRIOR ART

It is known in the prior art to provide a non-constricting brassier comprising a single piece of fabric formed of a stretchable material without any snaps or closures, as shown by the Fleischman U.S. Pat. No. 5,944,579. A major object of the Fleischman device is to provide a limited support brassiere with greater comfort than a traditional bra, and a brassiere that allows a woman's lymphatic system to flush the breast area of toxins. A major drawback of this prior invention is that it is not made of lightweight, comfortable disposable material and it does not provide for any holding capacity for absorbent pads in the nipple area to collect extraneous discharge.

It is also known in the art to provide a seamless brassiere formed from a circular knot fabric blank, as evidenced by U.S. Pat. Nos. 5,553,468 and 5,605,060 to Osborne; No. 5,592,836 to Schuster et al; No. 5,850,745 to Albright, and No. 6,287,168 to Rabinowitz. The object of the seamless brassiere inventions is to provide an inexpensive method of making the brassiere from tubular knit fabric, while also eliminating seams in sensitive areas of the body.

It is also known in the art to provide a multi-layer sports bra with an inner hydrophobic layer that wicks perspiration to outer hydrophilic layers, as shown by U.S. Pat. No. 5,441,436 to Moretz et al.

Finally, it is known in the art to provide a bust protector for nursing mothers with replaceable absorbent pads as disclosed by the Schnaittacher U.S. Pat. No. 1,989,382.

The inventions in the prior art do not address the needs of a lactating and breastfeeding mother for an undergarment holding absorbent pads in the nipple area for collecting extraneous discharge. The present invention was developed to provide a lightweight, stretchable, comfortable, breathable, disposable undergarment, which holds absorbent pads and is utilized during the initial days after giving birth and during the breastfeeding period primarily during sleeping hours when a nursing bra is not required.

SUMMARY OF THE INVENTION

It is the primary object of the invention to provide nursing mothers with a lightweight, stretchable, comfortable breathable disposable undergarment that holds absorbent pads to collect extraneous discharge. The undergarment is designed for maximum comfort and easy use while holding absorbent pads in the breast nipple area.

BRIEF DESCRIPTION OF THE FIGURES

Other objects and advantages of the invention will become apparent from a study of the following specification when viewed in the light of the accompanying drawing, in which.

DESCRIPTION OF THE PREFERRED EMBODIMENT

Figure 1:
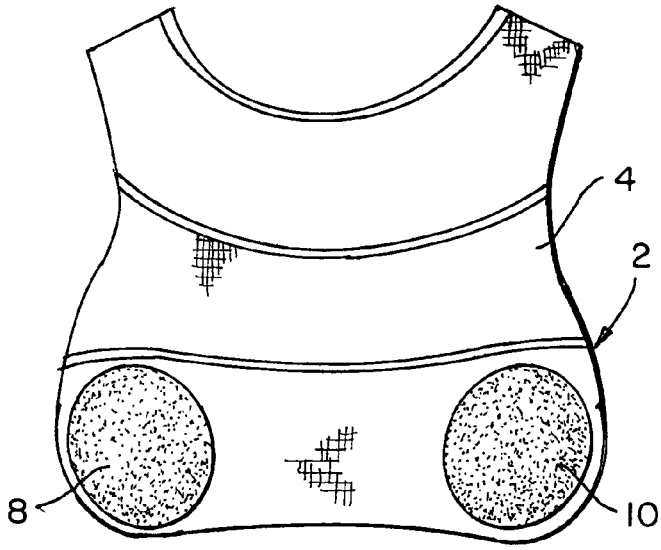
FIG. 1 is a front plan view of the undergarment according to the invention.
Figure 2:
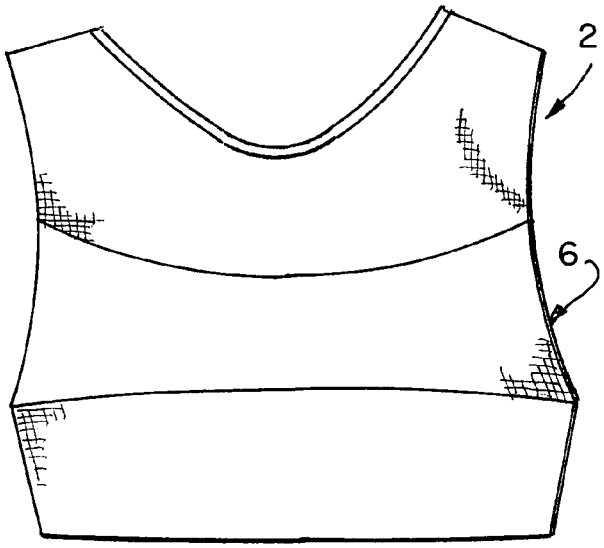
FIG. 2 is a rear plan view of the undergarment shown in FIG. 1.

Referring to FIGS. 1 and 2, there is shown a lightweight undergarment according to the preferred embodiment of the invention. The undergarment is made of a lightweight, stretchable, comfortable, breathable knit fabric, one size fits most, to accommodate different breast sizes. The undergarment includes a front panel 4 and a rear panel 6 with openings in the sides through which the wearer's arms pass, in the top for receiving the wearer's head, and in the bottom for the wearer's torso. Preferably, the front and rear panels are integrally formed as a unitary garment.

A pair of absorbent pads 8, 10 is held within the interior of the front panel in areas corresponding with the nipple area of the wearer. The pads are made of natural or synthetic absorbent material such as cotton or an absorbent polymer or a blend of cotton and polymer. Preferably, the pads are contoured to a slightly concave configuration for a better fit over the nipple area and improved comfort to the wearer.

Figure 3:
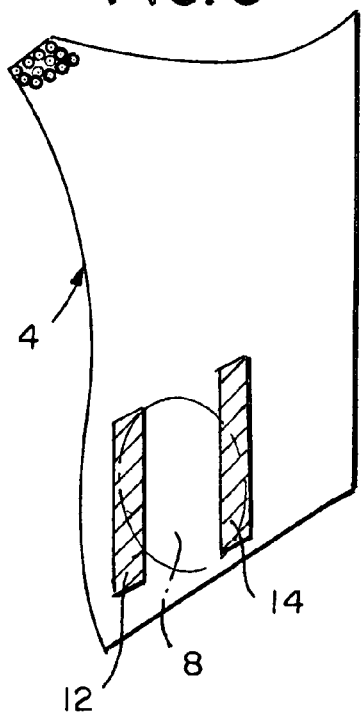
FIG. 3 is a partial cut-away view of the absorbent pad area of the undergarment.

The pads, preferably removable, are inserted in the rear surface of the front panel. In FIG. 3 is shown the preferred connection assembly for the absorbent pad 8 of FIG. 1. A similar assembly can be used for the pad 10 of FIG. 1. A pair of elastic strips 12 on FIG. 3 is connected at their ends with the inner surface of the front panel. The strips are either stitched to or integrally woven with the front panel. The strips are spaced a sufficient distance apart to allow the pads to be slipped under the edges of the strips. The central portion of the absorbent pad is unencumbered for direct contact with a nipple of the wearer for maximum absorption.

Because the pads are removable, they can easily be replaced when necessary. Disposal pads are preferred, however, as with the undergarment, the pads can be washed and reused if desired.

Alternatively, the entire undergarment can be manufactured as a disposable item. In this embodiment the pads can be incorporated into a pocket in the garment during manufacture, with the central interior portion of the pads being exposed for direct contact with the nipples of the wearer. When the pads are no longer able to serve their principal purpose, absorbing extraneous discharge, the undergarment is removed, disposed of, and replaced with a new undergarment.

While the preferred forms and embodiments of the invention have been illustrated and described, it will be apparent to those of ordinary skill in the art that various changes and modifications may be made without deviating from the inventive concepts set forth above.

What is claimed is:

1. A lightweight undergarment for lactating woman, comprising:

(a) generally tubular body formed of stretchable fabric of sufficient length to extend over a woman's breasts, said body including shoulder strap portions defining openings for arms of the woman to assist in positioning said body relative to the woman's breasts, said body conforming to the configuration of the woman's torso when in use;

(b) a holding device comprising a spaced pair of elastic strips having ends connected with an interior surface of said body in an area of said body opposite each of the woman's breasts; and (c) absorbent pads arranged between said strips and said body interior surface for removable connection with said body and covering at least the nipples of the breasts, whereby said pads absorb extraneous discharge from the lactating woman and are replaceable with clean absorbent pads.

2. An undergarment as defined in claim 1, wherein said absorbent pads are formed of one of cotton, polymer, and cotton/polymer blend material.

* * * * *